US012611069B1

(12) United States Patent
Searls, Sr.

(10) Patent No.: US 12,611,069 B1
(45) Date of Patent: Apr. 28, 2026

(54) MAGNETICALLY SEALED BATHING AREA LINER TRACK SYSTEM

(71) Applicant: Ronald Searls, Sr., Poinciana, FL (US)

(72) Inventor: Ronald Searls, Sr., Poinciana, FL (US)

( * ) Notice: Subject to any disclaimer, the term of this patent is extended or adjusted under 35 U.S.C. 154(b) by 119 days.

(21) Appl. No.: 18/641,312

(22) Filed: Apr. 19, 2024

Related U.S. Application Data

(60) Provisional application No. 63/460,585, filed on Apr. 19, 2023.

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/605, 610
See application file for complete search history.

(56) References Cited

U.S. PATENT DOCUMENTS 3,418,665 A * 12/1968 Long ..... A47K 3/30 4/610
4,358,863 A * 11/1982 Jacobsen ..... A47K 3/34 49/411
5,228,149 A * 7/1993 Phinn, Jr. ..... A47K 3/38 D6/578
6,023,794 A * 2/2000 Nein ..... A47K 3/34 4/557
6,892,783 B1 * 5/2005 Comeau ..... A47H 23/01 160/98
10,292,538 B2 * 5/2019 Tsibulevskiy ..... H04N 23/57
10,433,678 B1 * 10/2019 Peters ..... A47K 3/38
2003/0033667 A1 * 2/2003 Lachance ..... A47K 3/38 4/608
2007/0033874 A1 * 2/2007 Jacobs ..... E05D 15/08 49/130
2008/0109989 A1 * 5/2008 Sprague ..... E04B 2/827 16/96 R
2012/0005822 A1 * 1/2012 Daubmann ..... A47K 10/10 4/607
2013/0025232 A1 * 1/2013 Wang ..... A47K 3/34 52/656.4
2013/0117927 A1 * 5/2013 Woodruff ..... A47K 3/38 4/610

(Continued)

FOREIGN PATENT DOCUMENTS

WO WO-2008076260 A2 * 6/2008 ..... A47H 3/02

*Primary Examiner* — Lori L Baker
(74) *Attorney, Agent, or Firm* — Steven Ivy P.C.

(57) ABSTRACT

A magnetically sealed bathing area liner track system designed to improve access to showers or bathtubs in confined spaces while preventing water leakage. The system includes a threshold track mounted along the bathing area base, left and right striker beams attached vertically to opposing walls, a top track connecting the striker beams, and a shower liner suspended between the threshold and top tracks using movable liner holders. The threshold track features a low-profile design for easy entry, while the liner incorporates a splash guard to block water from escaping beneath it. Magnetic strips along the striker beams and liner edges engage upon closure, forming a continuous seal along both sides and the base. The system allows smooth manual opening and closing while maintaining a secure, water-tight barrier, offering an effective alternative to traditional shower doors.

16 Claims, 17 Drawing Sheets

MAGNETICALLY SEALED BATHING AREA LINER TRACK SYSTEM ("TRACK SYSTEM")

(56) References Cited

U.S. PATENT DOCUMENTS

| | | | | |
|---|---|---|---|---|
| 2013/0212799 | A1* | 8/2013 | Parker | A47K 3/34 4/558 |
| 2013/0239319 | A1* | 9/2013 | Serina | A47K 3/40 4/613 |
| 2013/0254984 | A1* | 10/2013 | Perez | A47K 3/30 4/607 |
| 2013/0333850 | A1* | 12/2013 | Walker-Dabner | A47K 3/38 160/349.1 |
| 2014/0000821 | A1* | 1/2014 | DeWees | A47H 13/02 160/330 |
| 2015/0208874 | A1* | 7/2015 | Austin, III | A47K 3/34 4/607 |
| 2016/0051094 | A1* | 2/2016 | Kee | A47H 1/00 4/608 |
| 2019/0038085 | A1* | 2/2019 | Ball | E05D 15/08 |
| 2022/0246285 | A1* | 8/2022 | Goelst | A47K 3/38 |
| 2023/0079958 | A1* | 3/2023 | Ellis | A47K 3/38 160/346 |
| 2023/0110656 | A1* | 4/2023 | Tsibulevskiy | A47K 3/281 4/607 |
| 2023/0292947 | A1* | 9/2023 | Mittal | A47H 23/00 4/610 |
| 2024/0384581 | A1* | 11/2024 | Marlowe | A47K 3/34 |
| 2025/0109769 | A1* | 4/2025 | Silveria | F16C 29/02 |

* cited by examiner

MAGNETICALLY SEALED BATHING AREA LINER TRACK SYSTEM ("TRACK SYSTEM")

MAGNETICALLY SEALED BATHING AREA LINER TRACK SYSTEM

RELATED PATENT APPLICATION

The present Non-Provisional U.S. Patent Application claims priority under 35 U.S.C. § 119(e) to U.S. Provisional Patent Application No. 63/460,585 titled Weighted Antimicrobial Beaded Shower Liner With Universal Shower Pan Track System, filed on Apr. 19, 2023, the subject matter of which is incorporated herein by reference.

FIELD OF THE INVENTION

The current invention relates to the wider domain of household or personal use items, with a specific focus on bathroom accessories.

BACKGROUND OF THE INVENTION

Shower curtains and shower doors are indispensable components of bathtubs or showers, serving to maintain privacy and contain water within the bathing area. Available in diverse sizes and designs, these fixtures come in two primary types: curtains placed inside the tub for both aesthetic appeal and practicality, and curtains or doors positioned outside the shower enclosure. Consequently, they are widely acknowledged as essential bathroom accessories.

The global market for bathroom accessories, has seen substantial growth in recent years. According to a report by Grand View Research, the global bathroom accessories market was valued at USD 20.2 billion in 2020 and is projected to grow at a compound annual growth rate (CAGR) of 5.3% from 2021 to 2028. This growth is driven by increasing trends in home renovation and remodeling, as well as the demand for more accessible and user-friendly bathrooms, particularly among aging populations.

Specifically focusing on shower curtains, the market is expected to grow at a rate of 8.25% from 2022 to 2029. This growth is attributed to changing lifestyles worldwide, with a growing preference for functional bathroom spaces. Additionally, the availability of a wide range of materials and designs to meet consumer demands, coupled with increased investment in infrastructure development, further stimulates market expansion.

Both in the United States and internationally, there is a growing demand for improved shower curtains designed for use in small spaces. While the impact is more pronounced in international markets, particularly in Europe and Asia, where small bathrooms are common, the need for space-saving solutions is increasingly recognized globally. Many bathrooms worldwide must accommodate multiple fixtures such as showers, toilets, sinks, and laundry machines, leaving limited space for movement. This poses challenges for traditional shower doors, which can obstruct access and present safety hazards due to their design.

In poorly designed or small bathrooms, shower glass doors can be particularly problematic. Often, the layout places fixtures like toilets or vanities in a way that obstructs access to the shower, leading to difficulties in opening the doors fully. This not only limits mobility but also poses safety risks, as poorly handled doors can shatter. Despite these issues, some users continue to opt for shower doors due to concerns that alternative solutions, such as shower curtains, may not effectively contain water within the bathing area and prevent flooding of the bathroom floor.

When shower doors are replaced with curtains or liners, it's often encountered that these alternatives may not function as intended. If the shower liner fails to snugly fit against the shower or bathtub wall, water can easily leak through gaps, resulting in drips onto the bathroom floor. Some liners are crafted from materials lacking proper coatings and deteriorate quickly, permitting water penetration and subsequent dripping beyond the shower area.

Furthermore, numerous shower curtains and liners incorporate round magnets designed to cling to the bathtub to prevent water from escaping. However, these magnets frequently struggle to adhere for several reasons. Bathtub materials, such as fiberglass or plastic, may lack magnetic compatibility, impeding the magnets' ability to stick, especially on uneven or rough surfaces. Additionally, some liners feature magnets with insufficient strength to securely adhere. Factors such as the weight of the liner itself or the use of powerful bathroom fans can cause the liner to drift away from the bathtub surface, resulting in gaps through which water can drip.

In situations where only a shower pan serves as the bathing area base, traditional liner magnets positioned at the bottom have nothing to hold onto, as there's no suitable surface for adherence. This issue is particularly common in spaces catering to seniors or individuals with disabilities due to their low entry thresholds. Unfortunately, for this demographic, aside from glass doors, there's a notable absence of leak-proof solutions available in the market.

The present invention, known as the Magnetically Sealed Bathing Area Liner Track System ("track system"), effectively addresses the previously outlined issues. This innovative device is designed to enhance accessibility to bathing areas, such as shower stalls and bathtubs, by replacing bulky and cumbersome shower glass doors, yet not making the entryway into the bathing area any more challenging.

The track system includes a shower liner that magnetically seals on both sides (left and right) and the water stopping bottom, integrating a splash guard and a low-profile threshold edge. This design ensures secure attachment of the shower liner to the shower pan or bathtub edge while offering individuals the convenience of easily opening either side of the liner when entering or exiting the bathing area. Unlike traditional methods requiring magnets or heavy objects to maintain tension in the liner, the magnetically sealed sides of the track system facilitate effortless closure without leaving any gaps where water can drip. The track system will contain the water inside the bathing area, equally or more effectively than any commercially-available shower glass doors.

BRIEF SUMMARY OF THE INVENTION

The following information is intended to be a brief summary of the invention, and as such, said information shall not be used as the means of limiting the scope of the invention:

Disclosed is a Magnetically Sealed Bathing Area Liner Track System ("track system") designed to enhance accessibility to bathing areas, such as shower stalls and bathtubs, by replacing bulky and often hazardous glass doors. This versatile track system can be tailored to fit various configurations, ranging from full-length shower stalls to shorter bathing areas with bathtubs. It comprises five primary components: the threshold track (including a threshold channel), left striker beam, right striker beam, top track (incorporating a top track channel), and a shower liner.

The threshold track is securely mounted to the bathing area base, positioned at the edge of the bathing area, whether it be the shower pan, the bottom of a bathtub, or the wall serving as the entryway into the tub itself. The track system features a series of liner holders, each equipped with rollers designed for smooth travel inside the threshold channel and the top track channel. Each of the liner holders also incorporates a hook intended to secure the shower liner via a plurality of grommets. These liner holders are strategically positioned within the threshold track and the top track, with end-cap carriages inserted at each end.

The left and right striker beams, each equipped with a magnetic strip, are mounted to the left and right bathing area entrance walls, respectively. These components form a frame mounted at the bathing area entrance, designed to hold the shower liner. The shower liner incorporates a splash guard, located next to the bottom hem of the liner, to prevent water from entering the threshold track, effectively sealing the bottom portion of the track system.

The shower liner's left and right edges are equipped with shower liner striker rails, each with a magnetic strip attached to it. These rails grip the holder pin of respective end-cap carriages, thereby stabilizing the edges of the shower liner. Additionally, these rails feature dual-function handles, enabling the end-user to open or close the liner from either side. When the liner is closed on either side, the magnetic strips of the liner striker rail come in contact with the magnetic strip of the respective striker beam mounted to the left and right bathing area entrance walls. The magnetic force firmly grips these components, effectively sealing the sides of the liner. The splash guard, along with the magnetic rails, ensures that water splashing inside the bathing area will not leak outside of it.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY

100—magnetically sealed bathing area liner track system ("track system")

110—threshold track
- 111—threshold mounting surface
- 112—threshold sloped surface
- 113—threshold channel
- 114—left threshold track end
- 115—right threshold track end

120—left striker beam
- 121—left striker magnetic strip
- 122—left striker beam tongue
- 123—left rabbet joint

130—right striker beam
- 131—right striker magnetic strip
- 132—right striker beam tongue
- 133—right rabbet joint

140—top track
- 141—top track channel
- 142—top track front wall
- 143—top track groove
- 144—left top track end
- 145—right top track end

150—plurality of liner holders
- 151—channel rollers (in each liner holder)
- 152—hook

160/170—shower liner
- 161—left shower liner edge
  - 162—left shower liner striker rail
  - 163—left shower liner striker rail top end
  - 164—left shower liner striker rail bottom end
  - 165—left striker magnetic strip
  - 166—left dual-function handle
  - 167—right shower liner edge
- 168—right shower liner striker rail
  - 169—right shower liner striker rail top end
  - 170—right shower liner striker rail bottom end
  - 171—right striker magnetic strip
  - 172—right dual-function handle
- 173—splash guard
- 174—top hem
- 175—bottom hem
- 176—plurality of grommets

180—four end-cap carriages
- 181—carriage channel wheels
- 182—carriage mounting platform
- 183—carriage holder pin

200—bathing area (shower stall, bathtub)
- 201—bathing area entrance (shower entrance, bathtub entrance)
  - 202—bathing area entrance left wall
  - 203—bathing area entrance right wall
- 204—bathing area base (shower pan, bathtub bottom)
  - 205—edge (of the bathing area base located at the bathing area entrance).

DETAILED DESCRIPTION OF THE PREFERRED EMBODIMENT

Figure 1:
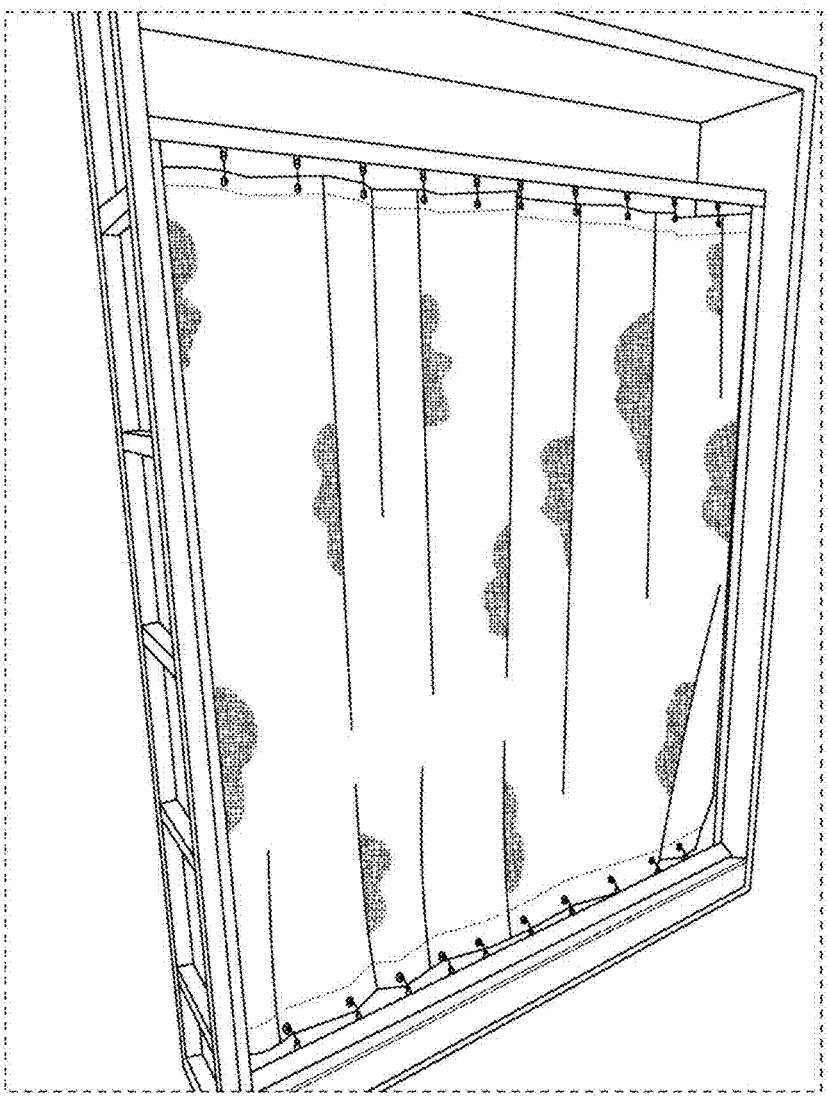
FIG. 1 depicts a perspective view of the current invention titled Magnetically Sealed Bathing Area Liner Track System ("track system"). This illustration aims to show all the primary components comprising the track system, namely the threshold track, left striker beam, right striker beam, top track, and the shower liner. Additionally, this figure highlights the installation location within the bathing area entrance, illustrating how the track system is mounted between the left and right walls of the bathing area entrance and atop the bathing area base (as an example, the bathing area utilized in this illustration is a shower stall); in accordance with an exemplary embodiment of the present invention.

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

As shown in FIG. 1, disclosed is a Magnetically Sealed Bathing Area Liner Track System ("track system"). The track system 100 is designed to enhance accessibility to bathing areas, such as shower stalls and bathtubs, by replacing bulky and cumbersome shower glass doors, yet not making the entryway into the bathing area any more challenging.

Figure 2:
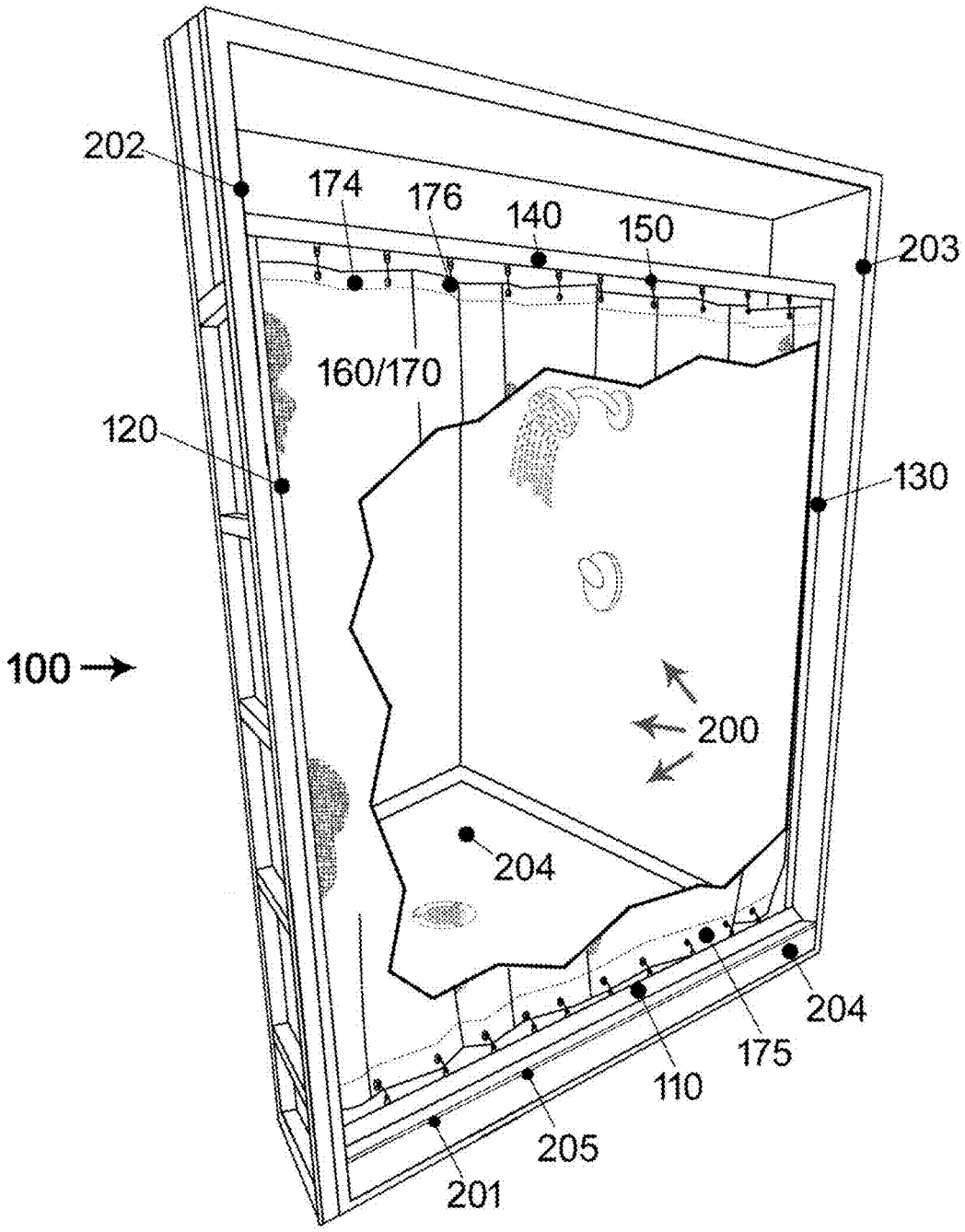
FIG. 2 presents a perspective view of the track system, aimed at displaying the front view of the bathing area entrance. It is designed to outlines the locations of various components using descriptive key numbers. The view depicts all the primary components of the track system and their placement within the bathing area entrance, including the threshold track, left striker beam, right striker beam, top track, and the shower liner. Additionally, the figure illustrates the positioning of subcomponents of the shower liner, such as the top hem, bottom hem, and multiple grommets; in accordance with an exemplary embodiment of the present invention.
Figure 3:
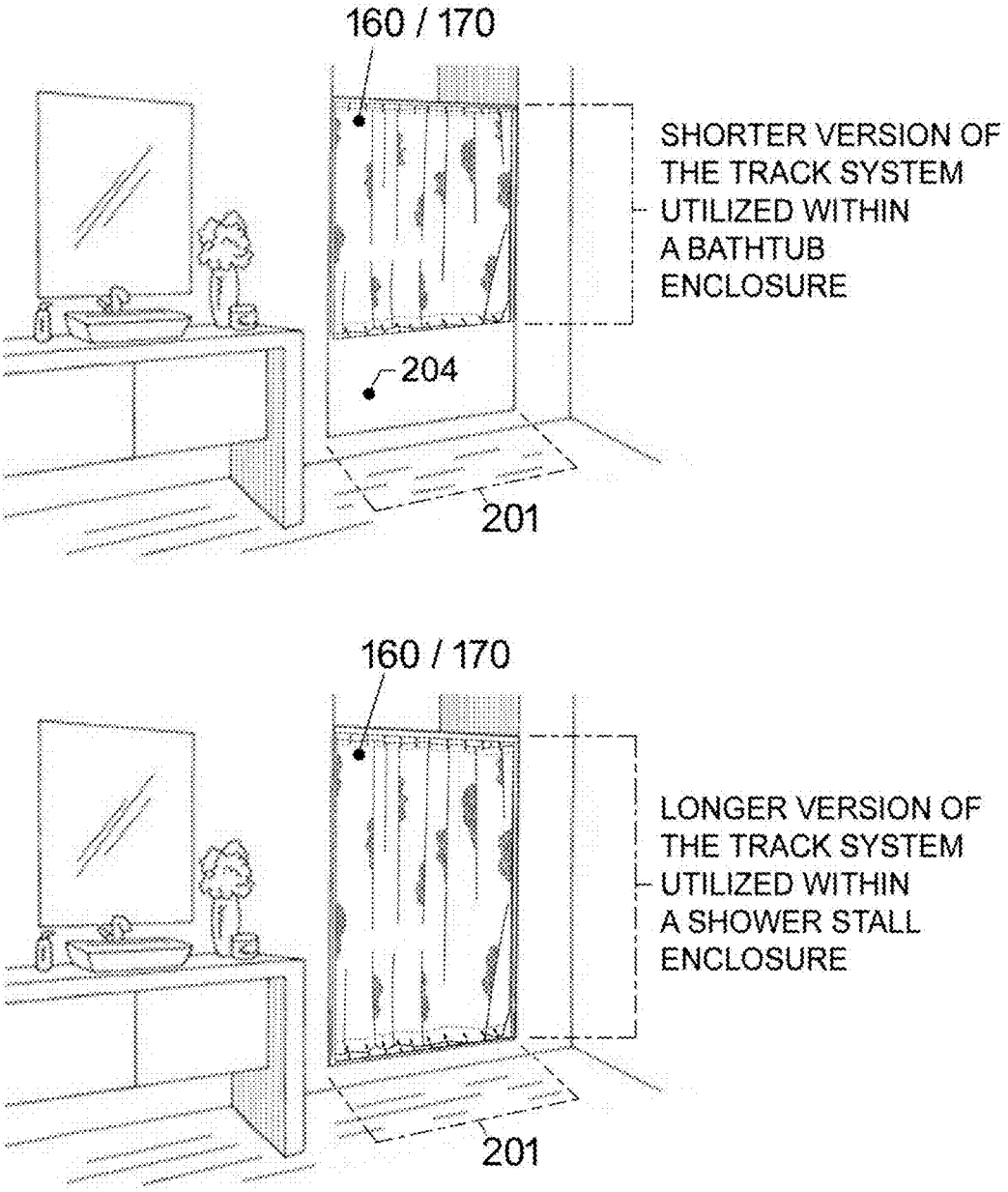
FIG. 3 provides two illustrations designed to demonstrate that the track system can be installed or used with different bathing areas, such as a shower stall or a bathtub. The top illustration shows the installation of the track used with a bathtub enclosure, where the track system design is shorter but functions exactly the same as the track system used with a shower stall, as shown in the illustration directly below; in accordance with an exemplary embodiment of the present invention.
Figure 4:
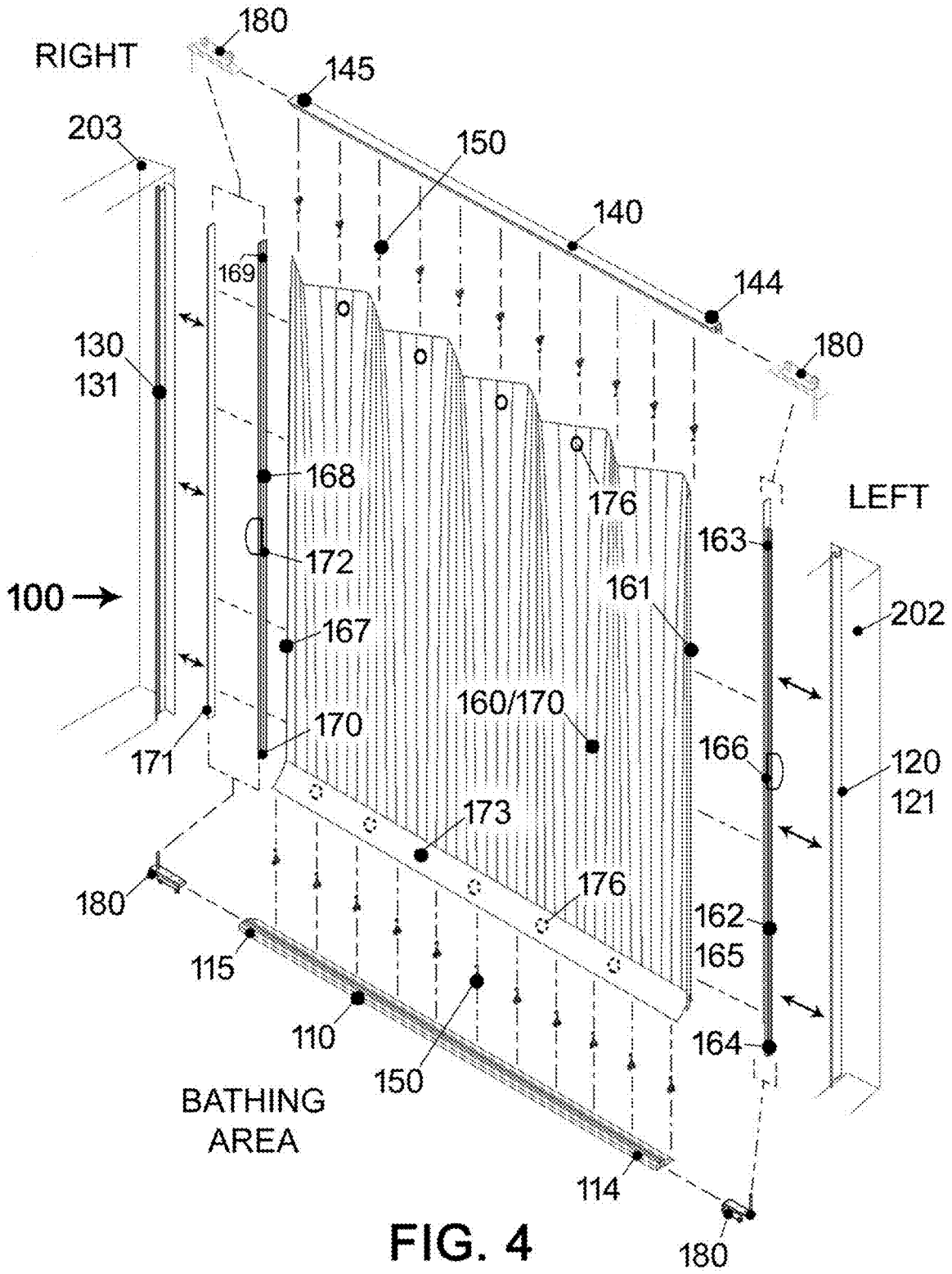
FIG. 4 depicts the track system from the vantage point of the bathing area. It presents an exploded view of the track system intended to delineate the locations of various components using descriptive key numbers. This figure outlines all primary components and many sub-primary components, including the positioning of the threshold track and its left and right ends, the placement of the left striker beam and the right striker beam, along with their respective magnetic strips. The figure also illustrates the positioning of the shower liner with its splash guard and both left and right striker rails. Furthermore, the figure displays the locations of four end-cap carriages and the track system's positioning between the left wall and the right wall of the bathing area entrance; in accordance with an exemplary embodiment of the present invention.

As shown in FIG. 3, the track system 100 can be tailored to fit various configurations, ranging from full-length shower stalls to shorter bathing areas with bathtubs. The track system 100, as shown in FIGS. 2 and 4, comprises five primary components, namely: threshold track 110, left striker beam 120, right striker beam 130, top track 140. These five components form a frame designed to hold a shower liner 160/170.

The threshold track 110 extends between a bathing area entrance left wall 202 and a bathing area entrance right wall 203. The threshold track 110 incorporates a left threshold track end 114, a right threshold track end 115, and a threshold mounting surface 111 used for mounting the threshold track 110 to an edge 205 of a bathing area base 204 located at the bathing area entrance 201.

Figure 5:
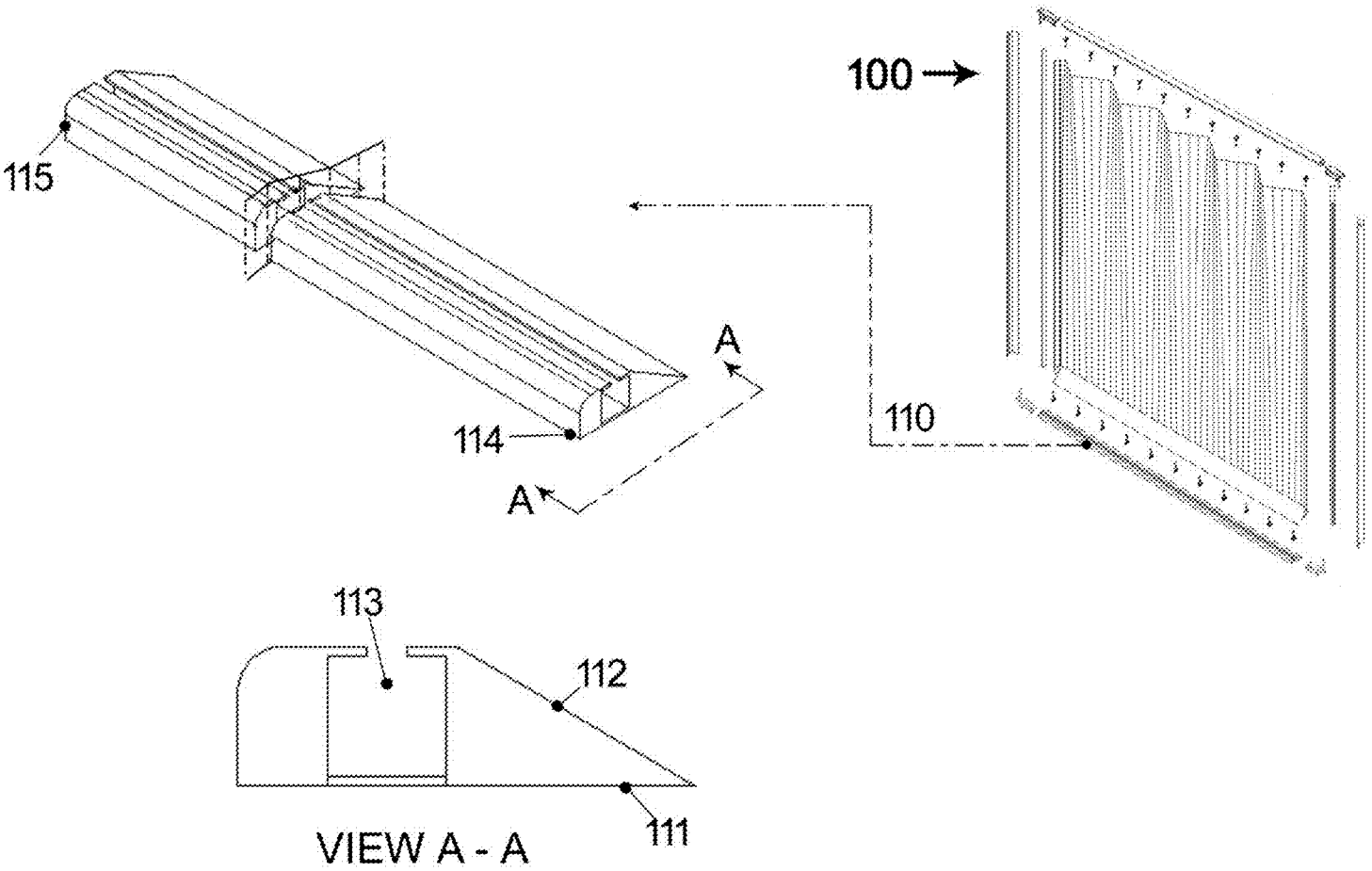
FIG. 5 consists of three illustrations. On the right side of the drawing is an exploded view of the track system, while on its left, at the top, is a perspective view of the threshold track, illustrating the location of the A-A view. Specifically, the exploded view shows the position of the threshold old track within the entire structure of the track system. Meanwhile, the A-A view, positioned below the perspective view of the threshold track, displays the locations of the threshold mounting surface, the threshold slope surface, and the threshold channel, which is utilized by a plurality of liner holders and the end-cap carriages (designed to hold the liner) to linearly travel inside; in accordance with an exemplary embodiment of the present invention.

In addition to the above-defined components, the threshold track 110 incorporates a threshold channel 113 and a threshold sloped surface 112, as shown in FIG. 5. The threshold sloped surface 112 is designed to minimize the profile of the threshold track 110 leading into the bathing area 200. This minimized profile of the threshold track 110 ensures that even individuals with mobility problems are not additionally impeded and can step over and into the bathing area 200.

The left striker beam 120 incorporates a left striker magnetic strip 121, a left striker beam tongue 122, and a left rabbet joint 123. The right striker beam 130 comprises a right striker magnetic strip 131, a right striker beam tongue 132, and a right rabbet joint 133.

Figure 8:
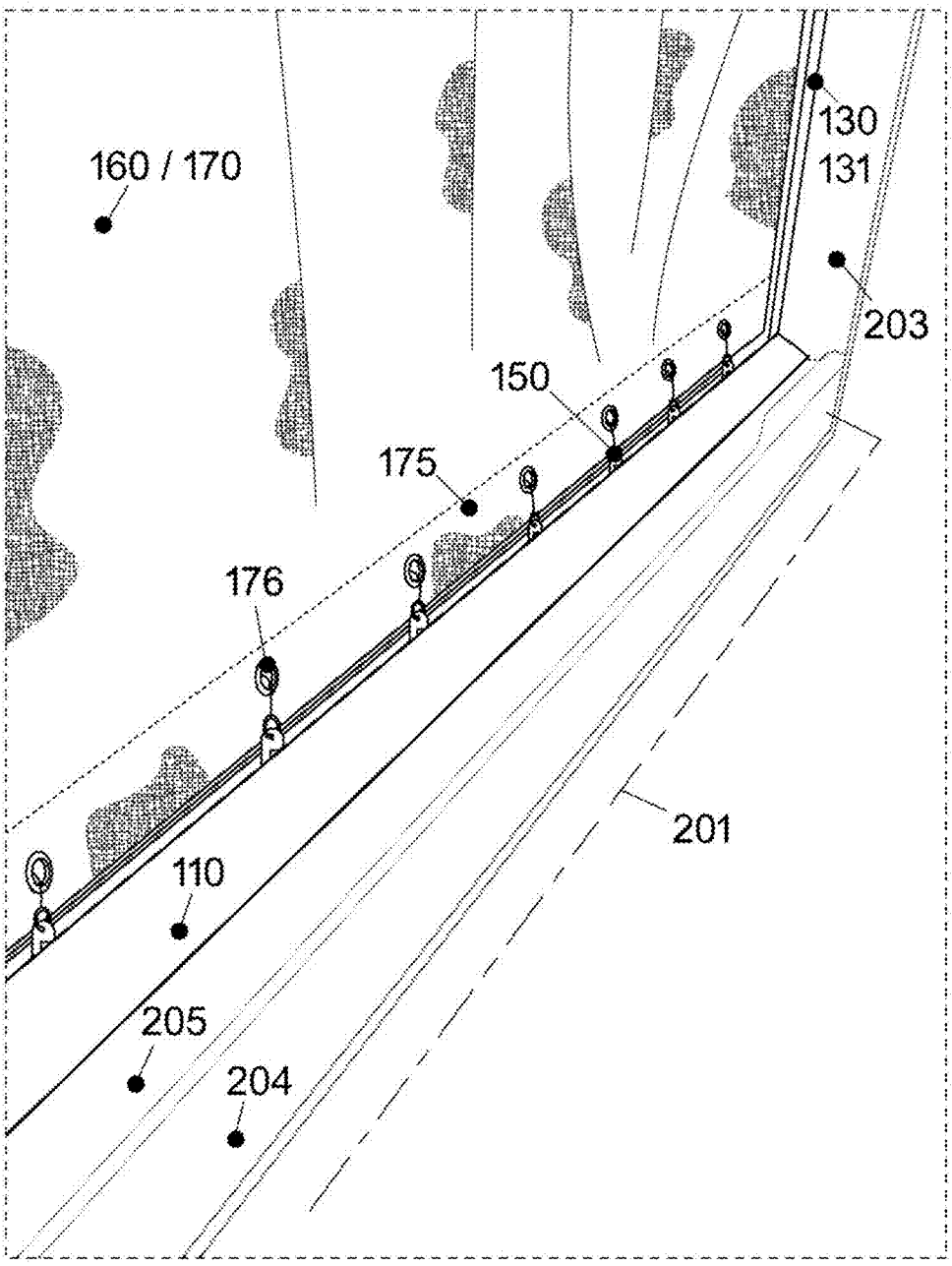
FIG. 8 displays a single illustration aimed at delineating various components situated near the threshold track, specifically near the right threshold track end. The illustration offers a view from the vantage point of the bathing area entrance, in this instance, a shower entrance. It outlines the location of the bathing area base, the bathing area edge, and the corresponding positioning of the threshold track. Additionally, the illustration highlights the location of the right striker beam, along with its magnetic strip attached thereto. Moreover, the illustration depicts the shower liner with multiple liner holders securing the liner via a series of grommets located horizontally along the bottom hem of the liner; in accordance with an exemplary embodiment of the present invention.

The shower liner 160/170, as depicted in FIGS. 4 and 8, features a left shower liner edge 161 and a right shower liner edge 167. The left shower liner edge 161 consists of several components, including the left shower liner striker rail 162, the top end of the left shower liner striker rail 163, the bottom end of the left shower liner striker rail 164, the left striker magnetic strip 165, and the left dual-function handle 166.

Similarly to the left shower liner edge 161, the right shower liner edge 167 comprises the shower liner striker rail 168, the top end of the right shower liner striker rail 169, the bottom end of the right shower liner striker rail 170, the right striker magnetic strip 171, and the right dual-function handle 172.

Figure 17:
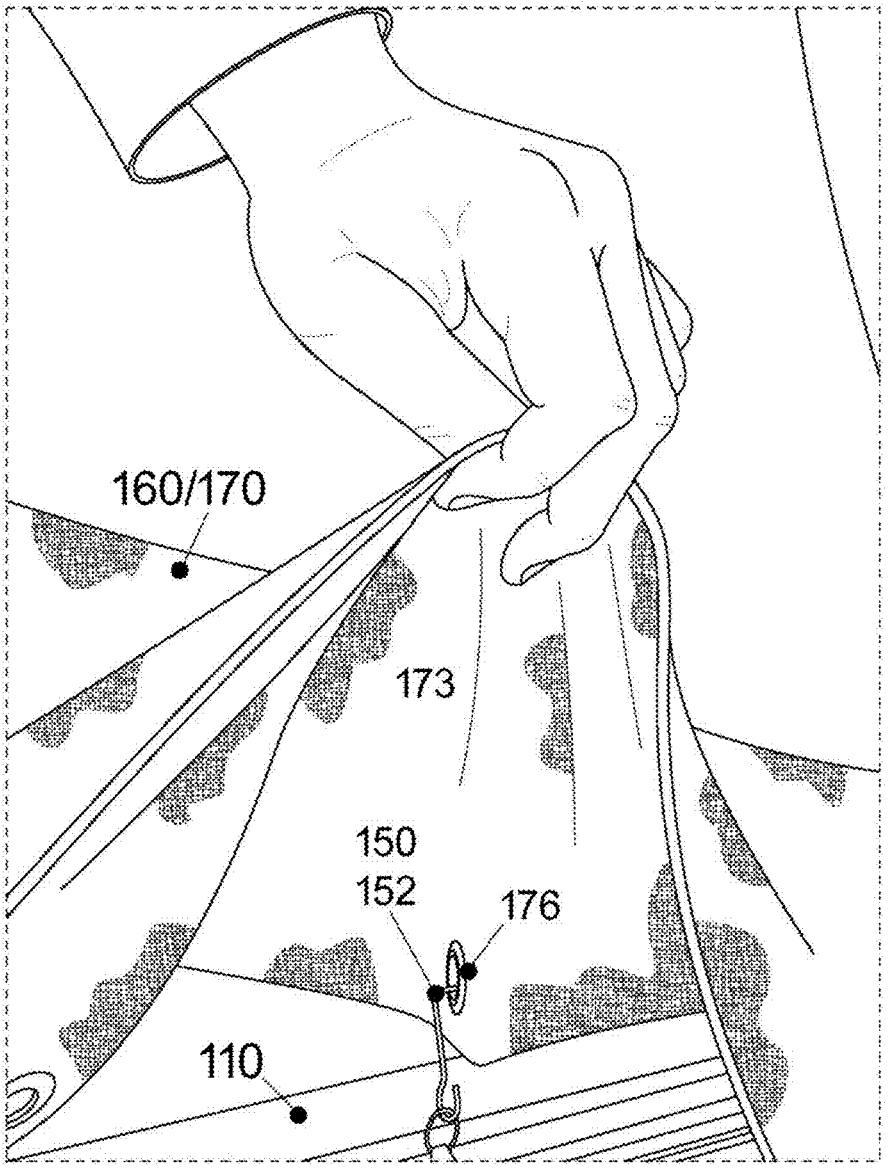
FIG. 17 highlights the splashguard of the shower liner. This illustration offers a view from within the bathing area, showing the user lifting the splashguard to expose the threshold track. Attached to the threshold track is a liner holder, which is connected to the liner by using a hook that grips onto the grommet disposed in the bottom hem of the shower liner; in accordance with an exemplary embodiment of the present invention.

The shower liner 160/170 is equipped with additional features, including a splash guard 173, showcased in FIGS. 4 and 17, a top hem 174, a bottom hem 175, and a plurality of grommets 176. The splash guard 173 is affixed to the bottom hem 175, serving to prevent water splashing inside the bathing area base 204 from seeping or spilling onto the threshold track 110, which houses the plurality of liner holders 150 and two end-cap carriages 180. Positioned and designed strategically, the splash guard 173 ensures effective sealing of the bottom portion of the track system 100, thus containing the water within the bathing area.

Figure 15:
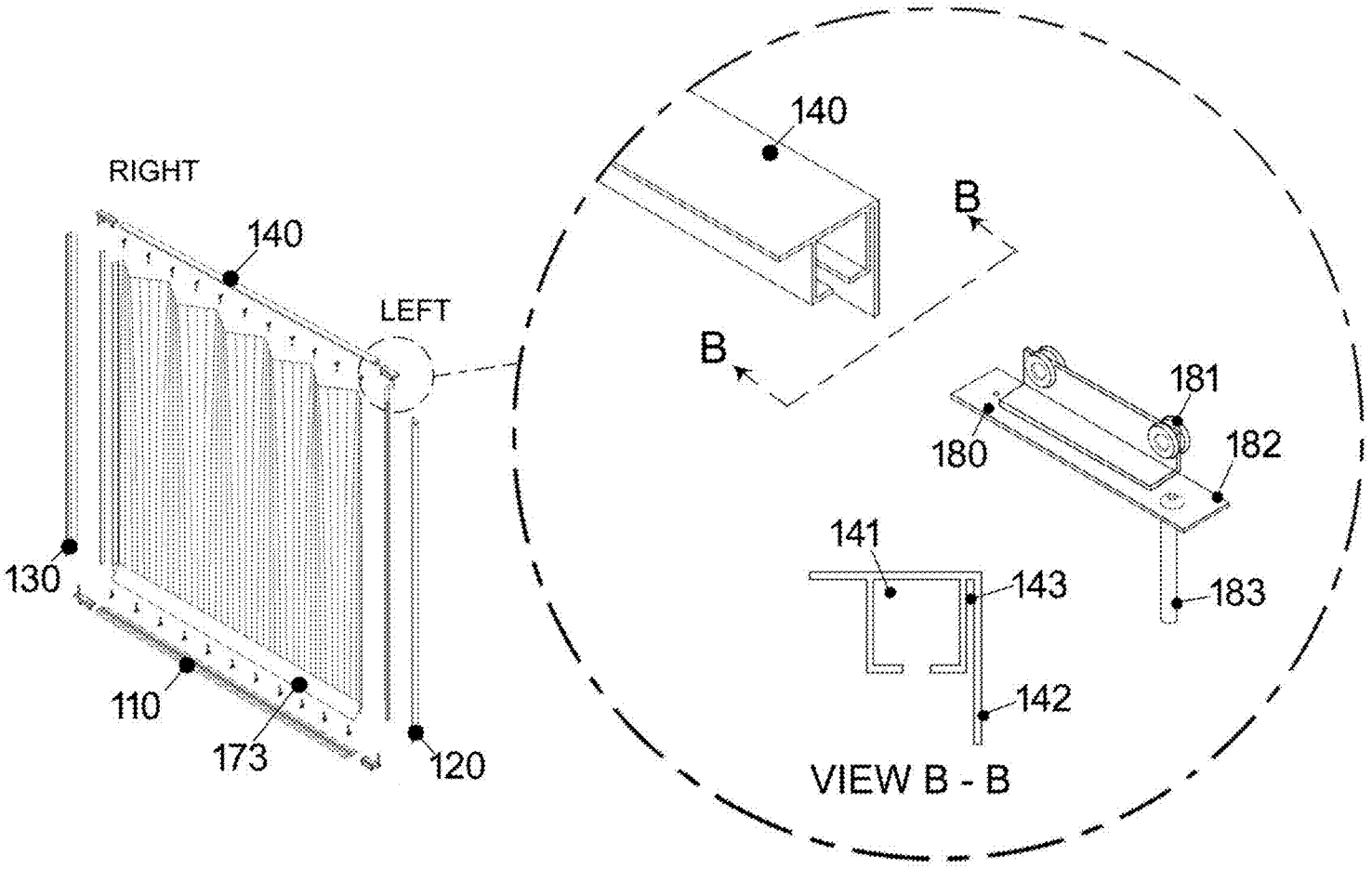
FIG. 15 includes two illustrations. On the left, an exploded view of the track system is displayed, while on the right, there is an enlargement focusing on the left top track. The enlargement illustration shows a short section of the top track indicating the positioning of the B-B view. Within the same enlargement, the provided view B-B is intended to outline the locations of various components, using descriptive keys. These include the locations of the top track front wall, the top track groove, and the top track channel. Additionally, the enlarged view shows the end-cap carriage positioned in an upside-down orientation, with the carriage holder pin pointing downward. This pin is designed to be gripped by the shower liner striker rail, which at the same time is attached to the left shower liner edge. The illustration also indicates the location of the carriage mounting platform and the carriage channel wheels. These wheels are designed to linearly travel inside the top channel when the shower liner is manually opened or closed; in accordance with an exemplary embodiment of the present invention.
Figure 16:
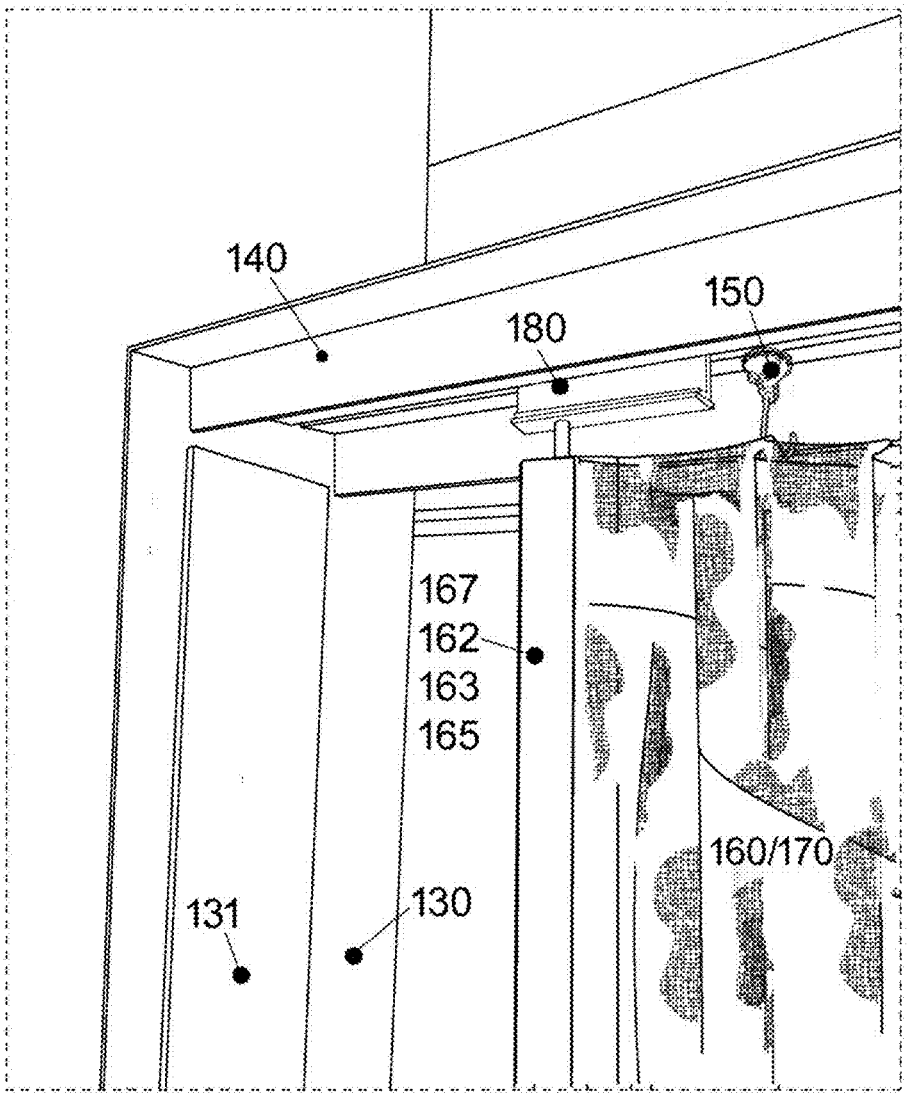
FIG. 16 presents a perspective view of the left top track end, depicted from the outside or from the point of view of the bathing area entrance. The illustration also depicts other components of the track system interacting with the top track. Specifically, the left striker beam and the left striker magnetic strip attached to it are mounted on the bathing area entrance left wall. The top track holds the shower liner or is connected to it via the end-cap carriage, which is gripped by the left shower liner striker rail. Additionally, the illustration shows that, apart from the end-cap carriage, the shower liner is held by the liner holder via the hook gripping onto the grommet disposed in the top hem of the shower liner; in accordance with an exemplary embodiment of the present invention.

The top track, as shown in FIGS. 2, 4, and 15, further comprises of a top track channel 141, a top track front wall 142, top track groove 143, left top track end 144, right top track end 145. The top track 140 as well as the threshold track 113 are designed to accept a plurality of liner holders 150.

Figure 6:
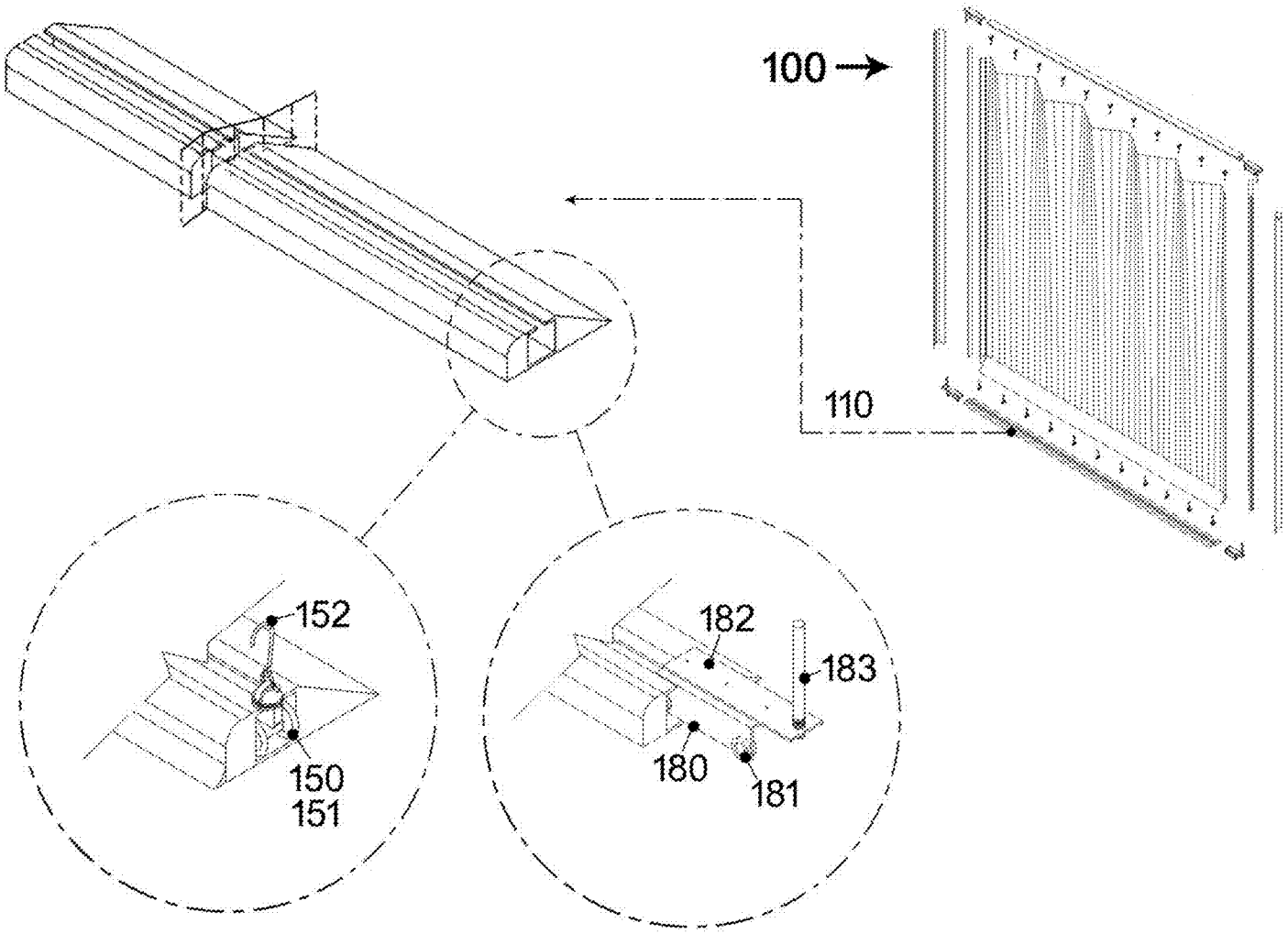
FIG. 6 comprises four illustrations. On the right side of the drawing is an exploded view of the track system. At the top left is a perspective view of the threshold track. Directly below are two illustrations focusing on the left side of the threshold track. The two illustrations are designed to convey the positioning of a liner holder inside the threshold track channel, as well as the positioning of one of the end-cap carriages inside the threshold track channel. Both components, the liner holder and the end cap carriage, are used to hold the shower liner and enable its horizontal, linear movement between the left and right striker beams; in accordance with an exemplary embodiment of the present invention.
Figure 7:
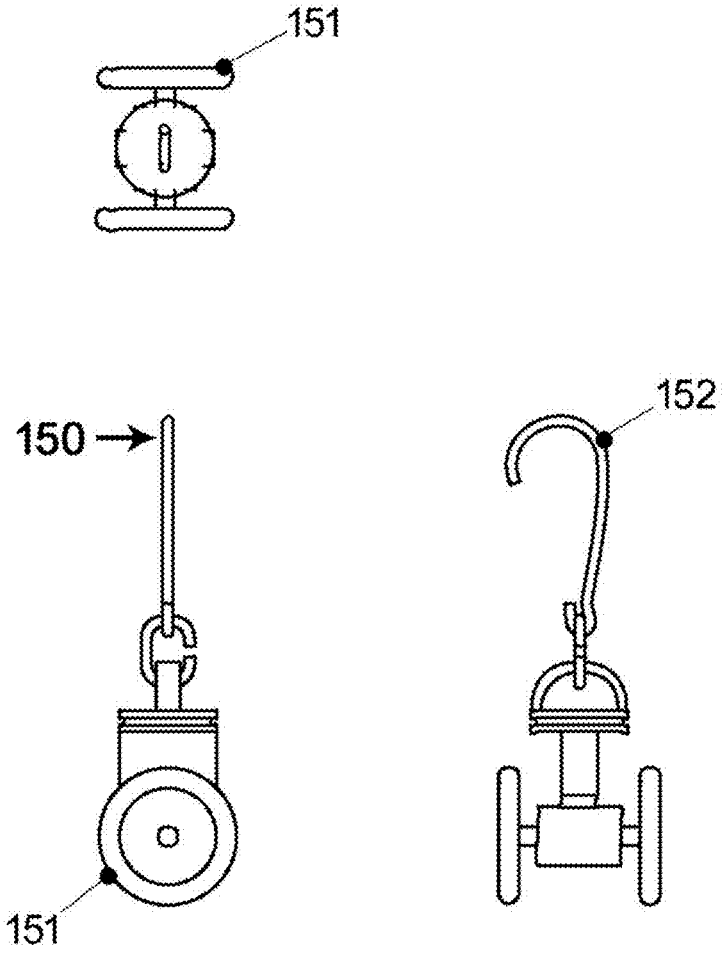
FIG. 7 presents three views of the liner holder. The figure displays the top, side, and front views of the holder, and is intended to illustrate, using descriptive key numbers, the locations of its two primary subcomponents. These are the channel rollers, with each holder having two rollers attached to it, and a hook. The hook is configured to connect to the channel rollers in a manner that allows the hook to travel along with any movement of the rollers, thereby enabling the horizontal moment of the liner; in accordance with an exemplary embodiment of the present invention.

Each of the liner holders 150, as shown in FIG. 7, incorporate two channel rollers 151 and a hook 152. The liner holders 150 are specially designed to fit inside the threshold track 113 and the top track channel 141 (shown in FIG. 6) and to linearly travel inside these tracks whenever the shower container 160/170 is moved by the end-user.

Figure 9:
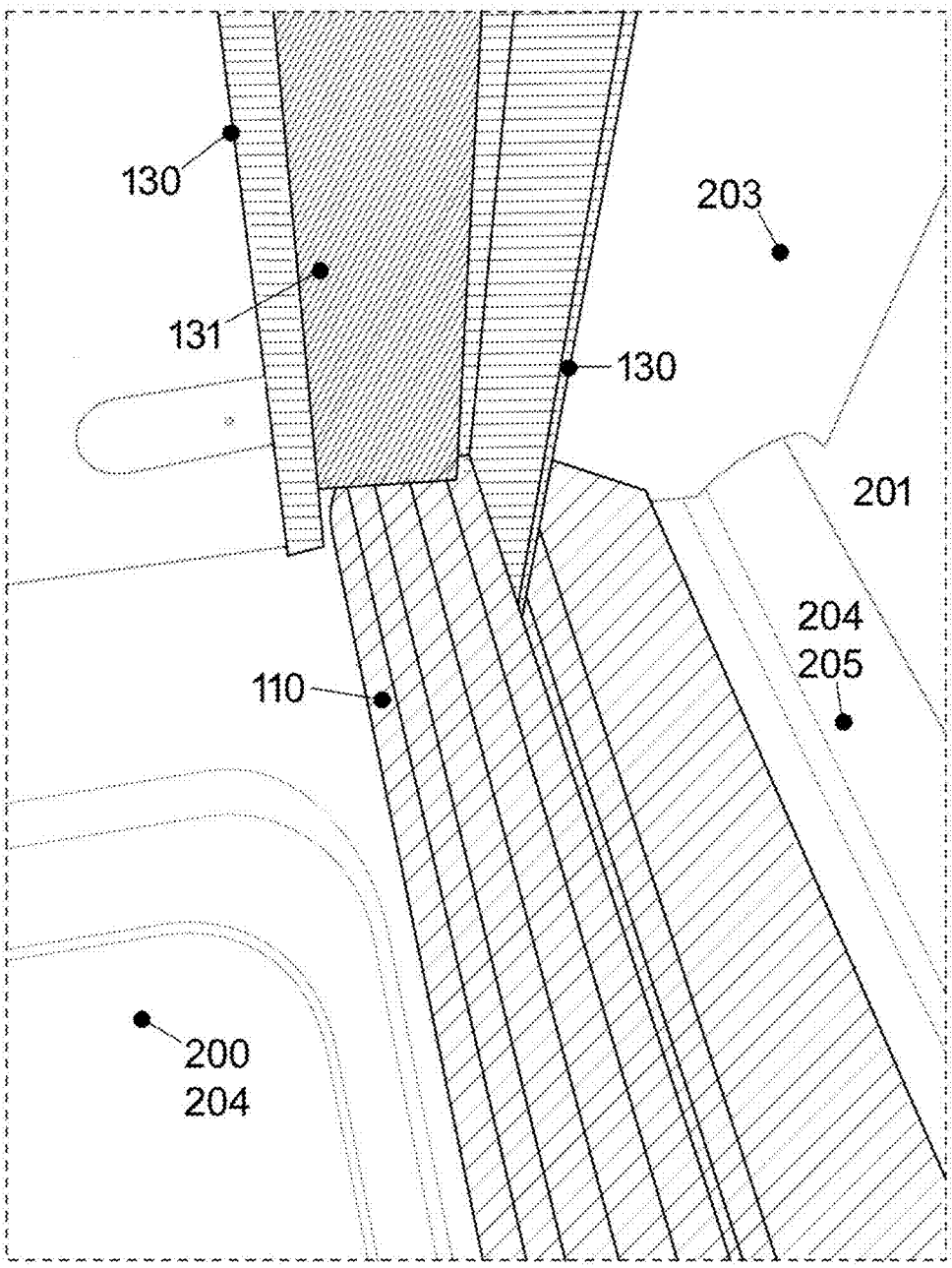
FIG. 9 shows a perspective view from inside the bathing area or from the bathing area base, looking towards the right threshold track end. The figure is intended to illustrate the positioning of the threshold track relative to the bathing area base and edge. Additionally, it depicts the interaction between the right striker beam, along with its attached magnetic strip, and the threshold track. These components are positioned perpendicular to each other, with the right striker beam situated on the right wall of the bathing area entrance; in accordance with an exemplary embodiment of the present invention.
Figure 10:
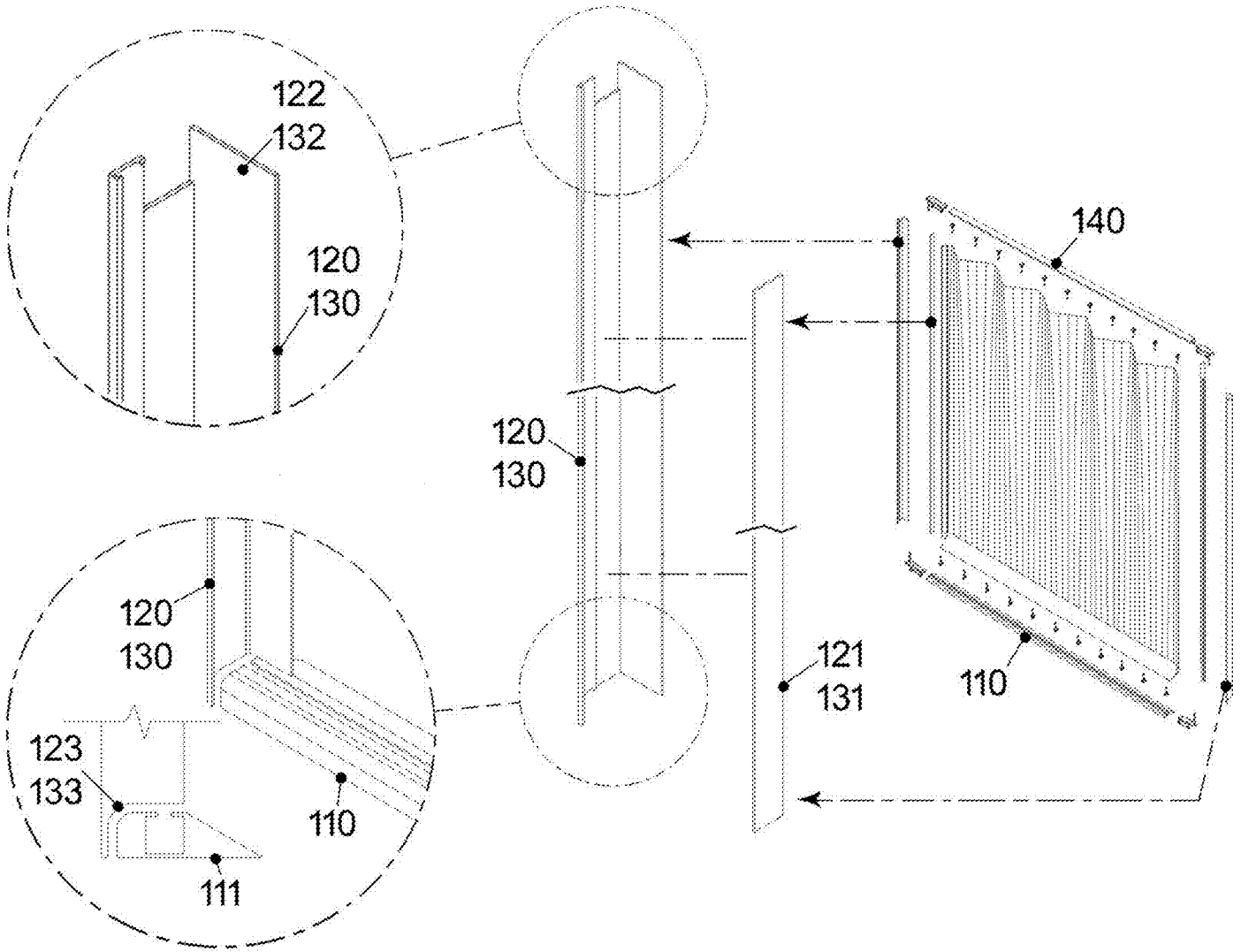
FIG. 10 shows five illustrations. On the right side is a figure displaying an exploded view of the track system, with a perspective view of a magnetic strip adjacent to it. This magnetic strip is utilized with both the right and left striker beams. To the left of the magnetic strip is a perspective view of a right striker beam. Adjacent to the striker beam are two enlarged views. The top enlarged view focuses on the striker beam tongue, a feature implemented in both the right and left striker beams. Directly below is a second enlarged view focusing on the bottom of the striker beam and its rabbet joint. These features (the beam tongue and the rabbet joint) are common to both the left and right striker beams. The purpose of the bottom enlarged view is to illustrate the left and right rabbet joints and their positioning in relation to the threshold track. These joints are designed to come together with minimal gaps, which could allow water to escape through; in accordance with an exemplary embodiment of the present invention.

To utilize the track system 100 the end-user must assembly the track system 100. To assemble the track system 100, the end-user must follow several steps. Firstly, as depicted in FIGS. 8 and 9, the threshold track 110 should be attached to the bathing area base 204, typically the shower pan. Once securely attached, the plurality of liner holders 150 can be inserted into the threshold channel 113. Subsequently, as illustrated in FIG. 6, an end-cap carriage 180 is positioned inside the threshold channel 113, specifically placing one at the left threshold track end 114 and another at the right threshold track end 115.

A total of four end-cap carriages 180 are utilized with the track system 100. Each carriage 180 comprises carriage channel wheels 181, designed to travel linearly inside the threshold channel 113 and the top track channel 141. Additionally, it includes a carriage mounting platform 182, intended for attachment to a carriage holder pin 183. This pin is specifically designed to be gripped by the left 162 and right 168 shower liner striker rails, specifically by their left shower liner striker rail top end 163, left shower liner striker rail bottom end 164, right shower liner striker rail top end 169, and right shower liner striker rail bottom end 170. These actions ensure that the left 161 and right 167 shower liner edges are rigid and vertically stable, facilitating the smooth opening or closing of the curtain liner without jamming.

Next, the left striker beam 120 is attached to the bathing area entrance left wall 202, and the right striker beam 130 is attached to the bathing area entrance right wall 203. Both striker beams 120 and 130 have their respective magnetic strips 121 and 131 attached to them. Once the left 120 and the right 130 striker beams are in position, the top track 140 can be mounted to those beams.

However, before the top track 140 is firmly attached, and similar to the threshold track 110, the plurality of liner holders 150 must be inserted inside the top track channel 141, as shown in FIG. 6. Once the plurality of liner holders 150 are in place, a single end-cap carriage 180 must be placed in the left top track end 144, and another end-cap carriage 180 must be placed inside the right top track end 145, as shown in FIG. 15. Once this process is completed, now the top track 140 is ready to be attached to the left 120 and right 130 striker beams.

Figure 13:
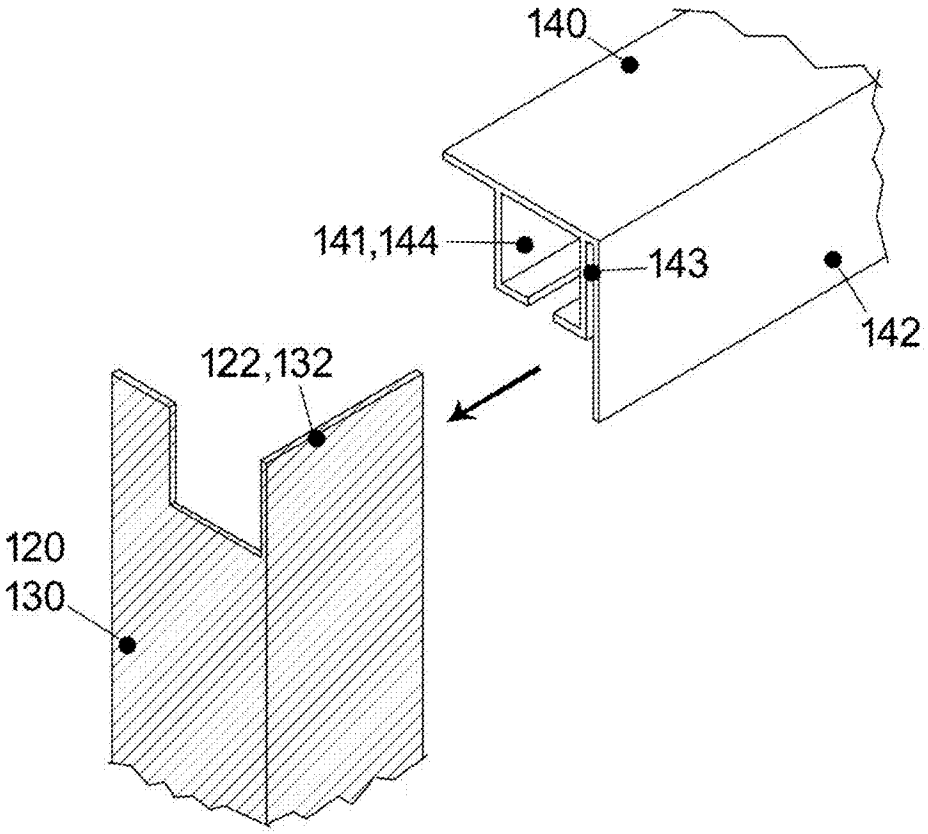
FIG. 13 illustrates two components: the top track and the left striker beam. The focus is on the left end of the top track and the positioning of its track groove. This groove is designed to slidably accept the striker beam tongue, forming a standard tongue and groove connection. This connection enables the quick assembly of the two components, while still leaving very small gaps through which water can flow. These gaps can easily be plugged using bathroom caulking products commonly available on the market; in accordance with an exemplary embodiment of the present invention.
Figure 14:
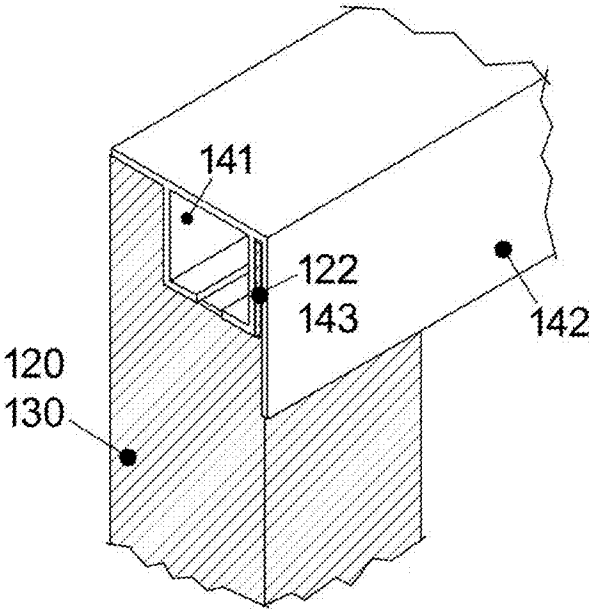
FIG. 14 continues the assembly process outlined in FIG. 13. Here, the two components, the top track and the left striker beam, are depicted as assembled together. This illustration demonstrates how the left striker beam tongue, which is also present on the right striker beam, is inserted inside the top track groove. Also, it shows that this connection between the two components creates a firm connection designed to minimize the flow of water through the gaps, which can easily be plugged using caulking products commonly available on the market. Additionally, the design of the top track ensures visual appeal as it is covered by the top track front wall, which is the only component visible to the end-user from the perspective of the bathing area entrance; in accordance with an exemplary embodiment of the present invention.

As illustrated in FIGS. 13 and 14, when connecting the left top track end 144 to the left striker beam 120, the left striker beam tongue 122 is slid into the top track groove 143 positioned on the left top track end 144. Similarly, the right striker beam tongue 132 is inserted into the top track groove 143 on the right top track end 145, following the same procedure on the opposite side of the top track 140.

Figure 11:
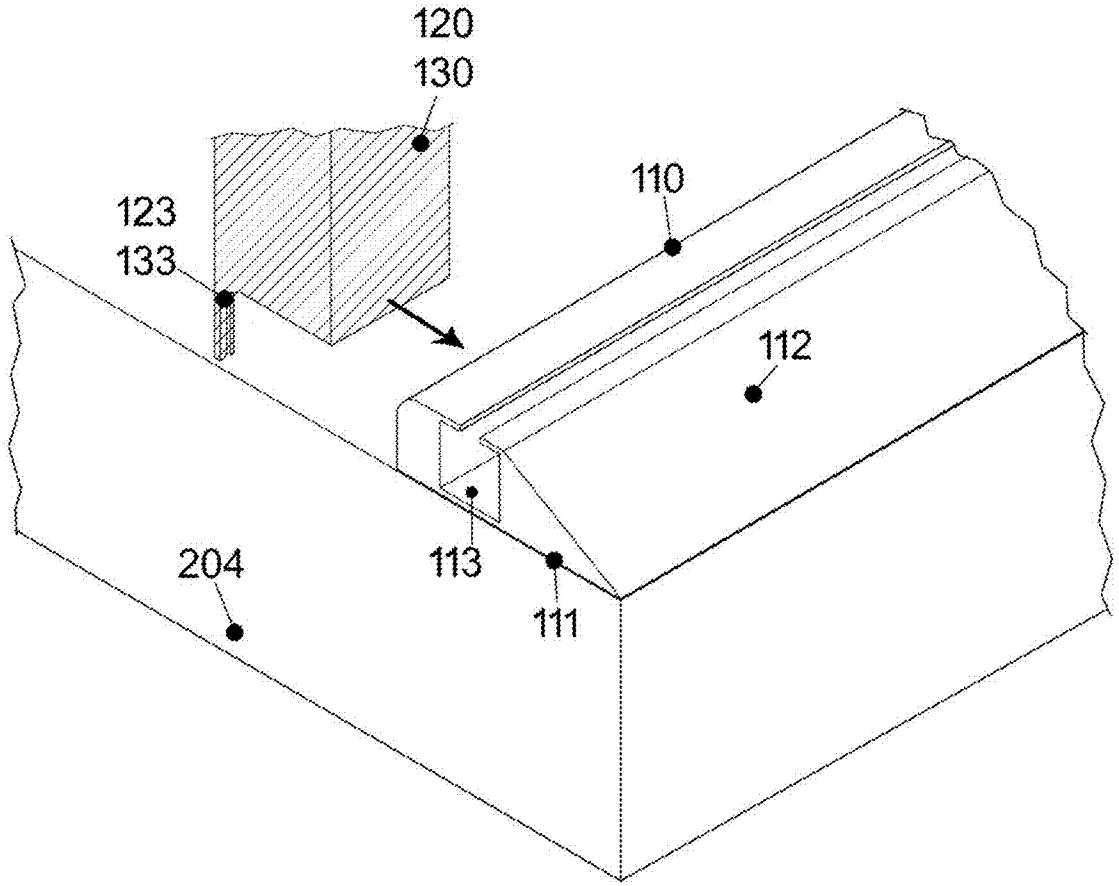
FIG. 11 focuses on three components: the bathing area base, the threshold track, and the striker beam. Specifically, the figure displays the left end of the threshold track and the pre-assembly of the left striker beam. The purpose of this illustration is to showcase the rabbet joint of the left striker beam and how the two components come together. It is evident in this illustration that the left rabbet joint is designed with ample space cut out from the striker beam to accommodate the contour of the threshold track. Upon connection with the threshold track, there will be continuous connection with minimal gaps that can be easily caulked to prevent any water seepage outside of the bathing area; in accordance with an exemplary embodiment of the present invention.
Figure 12:
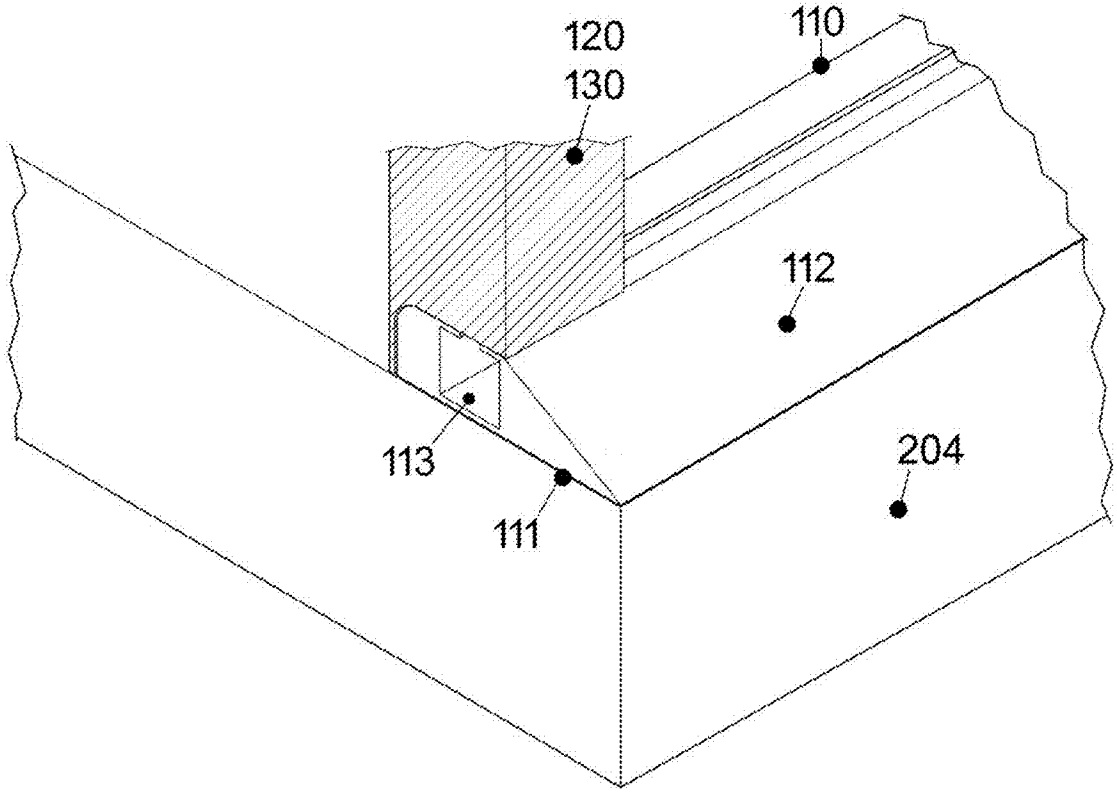
FIG. 12 emphasizes three elements: the bathing area base, the threshold track positioned directly on top of it or near its edge, and the left striker beam in its final position relative to the threshold track. This illustration aims to shows how the left rabbet joint of the left striker beam interacts with the threshold track by following its contour, thus minimizing gaps for water to escape through. An identical connection is utilized on the opposite side of the threshold track, at the right end, where the threshold track interacts with the right striker beam; in accordance with an exemplary embodiment of the present invention.

Following the attachment of the top track to the striker beams, the next step involves securing the left striker beam 120 to the threshold track 110, specifically at the left threshold track end 114, utilizing the left rabbet joint 123, as depicted in FIGS. 9, 11, and 12. Similarly, the right striker beam 130 is affixed to the right threshold track end 115 using the right rabbet joint 133. These rabbet joints 123/133 are intricately designed with a cutout to accommodate the contour of the threshold track 110. Upon connection with the threshold track 110, the rabbet joint ensures a snug fit with minimal gaps, which can be easily sealed to prevent any water from seeping outside of the bathing area 200.

Finally, the shower liner 160/170 can be secured between the threshold track 110 and the top track 140. As previously mentioned, the attachment of the shower liner 160/170 involves utilizing a plurality of liner holders 150. Each hook 152 of these liner holders 150 hooks onto a series of grommets 176 arranged horizontally along the top 174 and bottom 175 hem of the shower liner 160/170.

Once the track system 100 is properly installed, it prevents water from seeping through the bottom, or near the bathing area base 204, aided by the splash guard 173. Additionally, it prevents any water seepage from the bathing area's left or right sides through the presence of magnetic strips within the left 120 and right 130 striker beams, which upon contact with the shower liner striker rails 162 and 168, become magnetically connected effectively sealing the entire bathing area 200.

I claim:

1. A magnetically sealed bathing area liner track system, comprising:

(A) a threshold track, extending between a bathing area entrance left wall and a bathing area entrance right wall, comprising (a) a threshold mounting surface, for fixedly mounting the threshold track to an edge of a bathing area base located at a bathing area entrance, (b) a threshold sloped surface, configured to minimize profile of the threshold track leading into a bathing area and located therein the bathing area base, and (c) a threshold channel;

(B) a left striker beam, having a left striker magnetic strip longitudinally affixed thereto; said left striker beam is fixedly-mounted to the bathing area entrance left wall in vertical orientation and perpendicular to the threshold track; said left striker beam is configured to be contiguous with the threshold track;

(C) a right striker beam, having a right striker magnetic strip longitudinally affixed thereto; said right striker beam is fixedly-mounted to the bathing area entrance right wall in vertical orientation and perpendicular to the threshold track; said right striker beam is configured to be contiguous with the threshold track;

(D) a top track, having a top track channel, fixedly-mounted to and extending horizontally between the left striker beam and the right striker beam;

(E) a plurality of liner holders, configured to linearly travel within the threshold channel and within the top track channel;

(F) a shower liner, suspended between and moveably coupled via the plurality of liner holders to the threshold track and the top track; wherein said shower liner is comprising (a) a left shower liner edge, configured to have a left shower liner striker rail of corresponding length fixedly-attached thereto; said left shower liner striker rail comprises a left striker magnetic strip longitudinally affixed thereto configured to releasably attach to the left striker beam upon contact with it;

(b) a right shower liner edge, configured to have a right shower liner striker rail of corresponding length fixedly-attached thereto; said right shower liner striker rail comprises a right striker magnetic strip longitudinally affixed thereto configured to releasably attach to the right striker beam upon contact with it; and (c) a splash guard, configured to prevent water splashing in the bathing area base from spilling onto the threshold track and outside the bathing area entrance;

(G) wherein said shower liner is operable for manual opening and closing by using the plurality of liner holders traveling within the threshold channel and within the top track channel, and for magnetically sealing the bathing area by making the left shower liner striker rail contact the left striker beam and the right shower liner striker rail contact the right striker beam.

2. The magnetically sealed bathing area liner track system of claim 1, wherein said bathing area comprises a shower stall and a bathtub.

3. The magnetically sealed bathing area liner track system of claim 1, wherein said bathing area base comprises a shower pan and a bathtub bottom.

4. The magnetically sealed bathing area liner track system of claim 1, wherein said left striker beam further comprise of a left striker beam tongue configured to be contiguous with the threshold track by using a left rabbet joint.

5. The magnetically sealed bathing area liner track system of claim 1, wherein said right striker beam further comprise of a right striker beam tongue configured to be contiguous with the threshold track by using a right rabbet joint.

6. The magnetically sealed bathing area liner track system of claim 1, wherein said top track further comprises a top track front wall, and a top track groove disposed between the top track front wall and the top track channel; wherein said top track groove is configured for contiguous insertion of the right striker beam tongue and the left striker beam tongue.

7. The magnetically sealed bathing area liner track system of claim 1, wherein said shower liner further comprises a top hem, a bottom hem, and a plurality of grommets disposed linearly along the top hem and the bottom hem.

8. The magnetically sealed bathing area liner track system of claim 1, wherein said plurality of liner holders are configured to linearly travel within the threshold channel and within the top track channel by using channel rollers.

9. The magnetically sealed bathing area liner track system of claim 1, wherein each of said plurality of liner holders further comprises a hook, fixedly connected to the channel rollers and configured to releasably hook onto one of the plurality of grommets.

10. The magnetically sealed bathing area liner track system of claim 1, wherein said left shower liner striker rail further comprises a left dual-function handle configured to operate from inside and outside of the bathing area.

11. The magnetically sealed bathing area liner track system of claim 1, wherein said right shower liner striker rail further comprises a right dual-function handle configured to operate from inside and outside of the bathing area.

12. The magnetically sealed bathing area liner track system of claim 1, wherein said threshold track further comprises a left threshold track end and a right threshold track end.

13. The magnetically sealed bathing area liner track system of claim 1, wherein said top track further comprises a left top track end and a right top track end.

14. The magnetically sealed bathing area liner track system of claim 1, wherein said left shower liner striker rail further comprises a left shower liner striker rail top end and a left shower liner striker rail bottom end.

15. The magnetically sealed bathing area liner track system of claim 1, wherein said right shower liner striker rail further comprises a right shower liner striker rail top end and a right shower liner striker rail bottom end.

16. The magnetically sealed bathing area liner track system of claim 1, further comprising: four end-cap carriages each having (A) carriage channel wheels, configured to linearly travel within the threshold channel or within the top track channel;

(B) a carriage mounting platform, configured to interconnect the carriage channel wheels;

(C) a carriage holder pin, fixedly-mounted to the carriage mounting platform in perpendicular position to the threshold channel and the top track channel;

(D) wherein one of the four end-cap carriages is disposed inside the left threshold track end and is configured to be fixedly-attached via the carriage holder pin to the left shower liner striker rail bottom end;

(E) wherein one of the four end-cap carriages is disposed inside the left top track end and is configured to be fixedly-attached via the carriage holder pin to the left shower liner striker rail top end;

(F) wherein one of the four end-cap carriages is disposed inside the right threshold track end and is configured to be fixedly-attached via the carriage holder pin to the right shower liner striker rail bottom end; and (G) wherein one of the four end-cap carriages is disposed inside the right top track end and is configured to be fixedly-attached via the carriage holder pin to the right shower liner striker rail top end;

whereby in conjunction with the four end-cap carriages, the left shower liner striker rail and the rights shower liner striker rail are interconnected with both the top track and the threshold track, resulting in improved rigidity of the left shower liner striker rail and the rights shower liner striker rail thereby facilitating smoother opening and closing movements of the shower curtain, aided by the dual-function handles.

* * * * *